United States Patent [19]

Tani

[11] 4,088,494

[45] May 9, 1978

[54] SULFUR-SENSITIZED AgX EMULSION CONTAINING CUBIC AgX GRAINS AND A MERCAPTAN SENSITIZER

[75] Inventor: Tadaaki Tani, Minami-ashigara, Japan

[73] Assignee: Fuji Photo Film Co., Ltd., Minami-ashigara, Japan

[21] Appl. No.: 829,859

[22] Filed: Sep. 1, 1977

Related U.S. Application Data

[63] Continuation of Ser. No. 615,752, Sep. 22, 1975, abandoned.

[30] Foreign Application Priority Data

Sep. 20, 1974 Japan ..... 49-108997

[51] Int. Cl.[2] ..... G03C 1/28

[52] U.S. Cl. ..... 96/107; 96/109

[58] Field of Search ..... 96/107, 108, 109, 94 R

[56] References Cited

U.S. PATENT DOCUMENTS

| | | | |
|---|---|---|---|
| 2,843,491 | 7/1958 | Allen et al. | 96/109 |
| 3,241,971 | 3/1966 | Kitze | 96/107 |
| 3,655,394 | 4/1972 | Illingsworth | 96/108 |
| 3,671,258 | 6/1972 | Taber | 96/109 |
| 3,785,822 | 1/1974 | Overman | 96/107 |

*Primary Examiner*—Won H. Louie, Jr.

*Attorney, Agent, or Firm*—Sughrue, Rothwell, Mion, Zinn and Macpeak

[57] ABSTRACT

A chemically sulfur-sensitized silver halide photographic emulsion which contains: (1) at least 80 mol% silver bromide or silver chloride; wherein substantially are of the silver halide particles present are of the cubic crystal form; and (2) a sensitizing amount of an organic compound having at least one mercapto group and capable of reacting with a silver ion to form a water-insoluble silver salt. A method of sensitizing such an emulsion and a process of forming such an emulsion are also disclosed.

13 Claims, 1 Drawing Figure

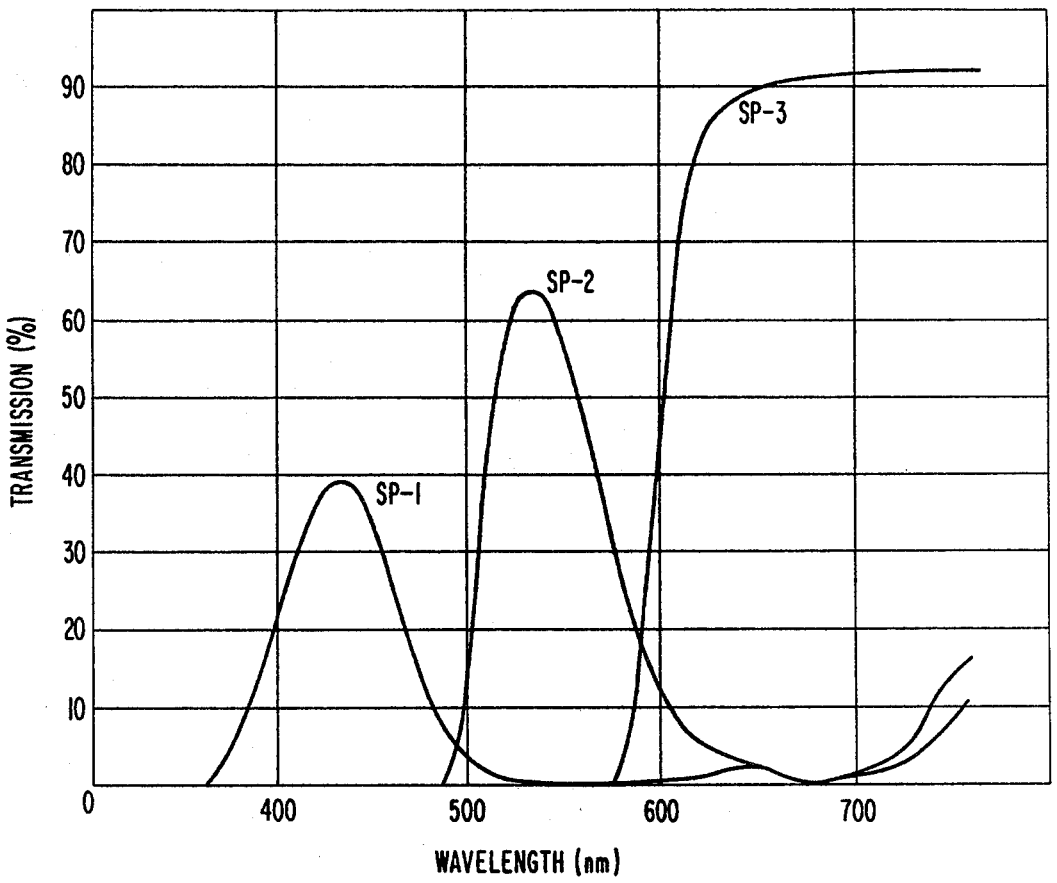
TRANSMISSION (%)
90
80
70
60
50
40
30
20
10
0
400
500
600
700
WAVELENGTH (nm)
SP-1
SP-2
SP-3

SULFUR-SENSITIZED AgX EMULSION CONTAINING CUBIC AgX GRAINS AND A MERCAPTAN SENSITIZER

This is a continuation of application Ser. No. 615,752, filed Sept. 22, 1975, now abandoned.

BACKGROUND OF THE INVENTION

1. Field of the Invention

The present invention relates to silver halide photographic emulsions having improved sensitivity and to a method for increasing the sensitivity of silver halide photographic emulsions. More particularly, it relates to a silver halide photographic emulsion and a method for increasing the sensitivity of a silver halide photographic emulsion by sulfur-sensitizing it and then incorporating a heterocyclic mercapto compound therein.

2. Description of the Prior Art

In the art of preparing photographic emulsions, it has been desired to increase the sensitivity of photographic emulsions without such being accompanied by fog.

A nitrogen-containing heterocyclic compound having a mercapto group is a known antifoggant and has been employed for the purpose of reducing fog. However, it is known that this compound also aften reduces photographic sensitivity. For example, see C. E. K. Mees & T. H. James "The Theory of the Photographic Processes (3rd. Edition)" pages 344 to 346.

Despite the above prior art belief, the inventor has found that the sensitivity of a sulfur-sensitized silver halide photographic emulsion can be increased by adding a particular nitrogen-containing heterocyclic compound having a mercapto group (which has been generally known as an antifoggant) to a sulfur-sensitized silver halide photographic emulsion containing at least one of silver bromide and silver chloride and silver halide particles of a cubic crystal form. This discovery is unexpected because it has been believed in the art that many nitrogen-containing compounds which are well-known as antifoggants reduce photographic sensitivity while inhibiting fog.

SUMMARY OF THE INVENTION

A first object of the invention is to provide a sulfur-sensitized silver halide photographic emulsion having increased sensitivity.

A second object of the invention is to provide a silver halide photographic emulsion having increased sensitivity without being accompanied by increased fog and deteriorated granularity.

The above objects of the invention are attained by incorporating a heterocyclic compound having at least one mercapto group, at least two aza nitrogen atoms in the molecule thereof and a pKa of not more than 7.6 into a sulfur-sensitized silver halide photographic emulsion containing at least 80 mol% silver bromide or silver chloride, wherein substantially all of the silver halide particles present are of the cubic crystal form.

BRIEF DESCRIPTION OF THE DRAWING

The drawing is a curve showing the spectral transmittance ratio of the blue filter (SP-1) which is employed in Examples 1 and 3.

DETAILED DESCRIPTION OF THE INVENTION

The nitrogen-containing heterocyclic compound having a mercapto group employed in the invention has at least two aza nitrogen atoms in the molecule. However, the aza heterocyclic ring of the compound can have an atom other than the aza nitrogen atoms, such as oxygen atom, sulfur atom, selenium atom, etc., and in fact not all nitrogen atoms need be aza nitrogen atoms so long as at least two aza nitrogen atoms are present. Most preferably, however, no more than four aza nitrogen atoms are present in the molecule. Preferred compounds within the above definition of heterocyclic compounds are 5- or 6-membered monocyclic heterocyclic compounds having at least two aza nitrogen atoms and a mercapto group attached to a carbon atom adjacent to a nitrogen atom, which may be an aza nitrogen atom, if desired, or heterocyclic compounds having two or three condensed heterocyclic rings, each of the heterocyclic rings having at least one aza nitrogen atom, and having a mercapto group attached to a carbon atom adjacent to a nitrogen atom, which may be an aza nitrogen atom, if desired.

A nitrogen-containing heterocyclic compound having a mercapto group employed in the invention must have a pKa of not more than 7.6. Examples of such heterocyclic rings include a pyrazole ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, a ring formed by condensing two or three of such rings such as a triazolotriazole ring, diazaindene ring, triazaindene ring, tetrazaindene ring or pentazaindene ring, etc. A heterocyclic ring formed by condensing a monocyclic hetero ring with an aromatic ring such as phthalazine ring or indazole ring can be also used.

Of these rings, a 1,2,4-triazole ring, 1,3,4-thiadiazole ring, 1,2,3,4-tetrazole ring, 1,2,4-triazine ring, triazolotriazole ring or tetrazaindene ring are preferred in the invention.

Even if these rings are used, the pKa of the ring(s) may be over 7.6 due to the substituent(s) thereon or the substituent position(s) thereof; it is thus necessary to select a substituent(s) and a substituent position(s) thereof so that the pKa is not more than 7.6 (measured in water at 25° C at an ionic strength of 0.1).

A mercapto group(s) can be bonded to any carbon atom(s) on these rings; preferably it is bonded to a carbon atom so that the following bonds are formed:

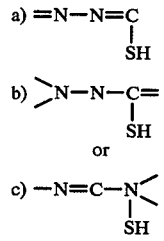

Substituents other than the mercapto group can be attached to the heterocyclic ring. As examples of such substituents, there are an alkyl group having not more than 8 carbon atoms (e.g., methyl group, ethyl group, cyclohexyl group, cyclohexylmethyl group, sulfoethyl group, hydroxymethyl group, etc.), an alkoxy group having not more than 8 carbon atoms (e.g., methoxy group, ethoxy group, etc.), an alkylthio group having not more than 8 carbon atoms (e.g., methylthio group, butylthio group, etc.), a hydroxy group, an amino group, a hydroxylamino group, an alkylamino group having not more than 8 carbon atoms (e.g., methylamino group, butylamino group, etc.), a dialkylamino group having not more than 8 carbon atoms (e.g., diethylamino group, diisopropylamino group, etc.), an arylamino group (e.g., anilino group, methylanilino, chloroanilino, methoxyanilino, naphthoanilino, etc.), an acylamino group (e.g., acetylamino group, etc.), a halogen atom (e.g., chlorine atom, bromine atom, etc.), a cyano group, a carboxy group, a sulfo group, a sulfato group, a phospho group, etc. These substituents should be selected so that the pKa of the compound is not more than 7.6

The pKa of the compounds can be measured by a potentiometric titration method as disclosed in A. Albert & E. P. Serjeant, "Ionization Constants of Acids and Bases, a Laboratory Manual", 1st. ed. (1962).

Typical examples of compounds having a mercapto group employed in the invention are set forth below, but the compounds of the invention are not to be limited to the examples.

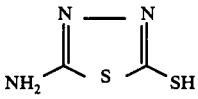
Compound (I)

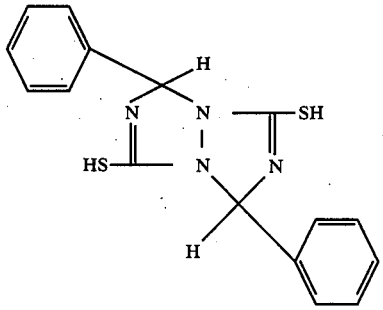
Compound (II)

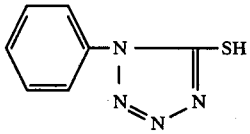
Compound (III)

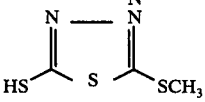
Compound (IV)

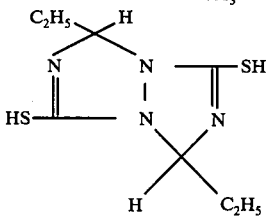
Compound (V)

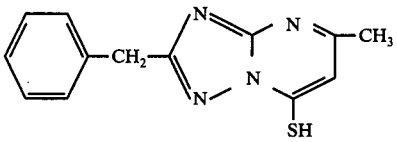
Compound (VI)

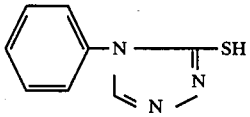
Compound (VII)

Compounds (I), (III), (IV) and (VII) are most preferred in the present invention.

It is known in the sulfur sensitization art that certain sulfur compounds are effective for chemical sensitization of silver halide photographic emulsions. As such compounds, allylthiourea, allyl isothiocyanate, sodium thiosulfate, cystine, etc., have been used. However, these compounds all have unstable sulfur and form silver sulfide in the presence of silver ions. In the case where a silver halide photographic emulsion is chemically sensitized by these compounds, after water-soluble silver salt is sufficiently removed [whereby the system containing the silver halide emulsion has, for example, a pAg of not more than 9.0], the silver halide emulsion must be heated for a period of time in the presence of these compounds. This operation is called chemical ripening. It is believed that the effect of sulfur sensitization is based on the fact that the sulfur compound reacts with the silver ion present in the silver halide particles to form a silver sulfide nucleus which is called a sensitization nucleus.

According to the invention, after carrying out sulfur sensitization in a conventional manner, whereby the maximum sensitivity obtainable by the sulfur sensitization is obtained, a mercapto compound of the invention is added to the sulfur-sensitized silver halide emulsion, whereby remarkably increased sensitivity can be obtained. The thus treated silver halide photographic emulsion need not be heated (chemically ripened) in the presence of the mercapto compound, though such can be performed, if desired. Therefore, the effects of the mercapto compound employed in the invention are different from those of unstable sulfur compounds.

Some of the mercapto compounds employed in the invention are well-known as antifoggants and this antifogging mechanism has been confirmed. In spite of various opinions on the mechanism of antifogging, it has generally been believed that the antifogging function of such compounds is based on the fact that the compounds can generally form a water insoluble silver salt, i.e., the compounds react with silver ions to form a water insoluble silver salt rather than to form silver sulfide, which mechanism is different from the physical chemistry viewpoint from the sulfur sensitizer. Accordingly, if the heterocyclic mercapto compound employed in the invention is incorporated in a silver halide emulsion which is not sulfur-sensitized or which does not contain a sulfur sensitizer, and then is heated (ripened), the sensitivity of the emulsion is not substantially increased. The sensitization effects of the heterocyclic mercapto compound are thus seen to be different from that of sulfur sensitization.

It is described in U.S. Pat. No. 3,785,822 that a mercapto compound having a pKa of not less than 7.7 can reduce the induction period of development, particularly the induction period for a high contrast development (often called lithographic development) which is generally carried out in the presence of a dihydroxybenzene type developing agent at low concentrations of sulfite ions; in this U.S. Patent, such results can be obtained by a developer containing a high concentration of sulfite ions.

However, the increase in sensitivity attained by the invention is different from the result of reducing the development induction period. That is, in case of reducing the development induction period the image contrast at the initial stages of development increases, but according to the present invention contrast does not increase. Further, in the case of the prior art technique of reducing the development induction period, there is no difference in photographic properties upon the completion of development if the development is prolonged, whereas an elevation of sensitivity with the present invention is clear if development is prolonged.

In greater detail, a decrease in the induction period in development effects the initial stages of development but does not effect the photographic characteristics finally obtained. As a matter of course, an increase of sensitivity cannot be obtained at the final stages of development.

In the invention, it is necessary that the pKa, not be over 7.6. If the pKa of the mercapto compound is over 7.6, the objects of the invention cannot be attained because the results in that case are inferior.

As illustrated by the Examples and the Comparative Examples described below, the silver halide photographic emulsion of the present invention contains at least 80 mol% of silver bromide and/or silver chloride, and the silver halide particles of the emulsion are composed of substantially cubic crystals, i.e., substantially means 80% or more, preferably 90% or more by weight (based on all silver halide), of the silver halide is cubic. If these criteria are not met a sensitivity higher than that obtained by sulfur sensitization per se cannot be obtained. If the content of silver bromide and/or silver chloride is less than 80 mol%, the sensitization due to the mercapto compound cannot be attained no matter what crystalline form the silver halide particles have. On the other hand, if the silver halide particles do not have a substantially cubic form, the most effective results of the present invention cannot be obtained even if at least 80 mol% of the silver halide in the silver halide photographic emulsion is silver bromide and/or silver chloride.

The silver halide employed for the emulsion of the invention can be silver bromide, silver iodobromide, silver chlorobromide, silver iodochlorobromide, silver chloride or silver iodochloride, but at least 80 mol% of the silver halide must be at least one of silver bromide and/or silver chloride, and the silver halide particles must be substantially of the cubic crystal form. The remaining 20% or less of the silver halide, while limited as to shape (substantially cubic) is not limited as to halide, e.g., AgBrI, AgBrCl, AgBrClI can be used. In the case of using a silver iodobromide emulsion or a silver iodochlorobromide emulsion, the silver iodide content is preferably not more than 3 mol%, and most preferably, the content of silver iodide is 0 to 1.5 mol%.

In the case where the silver bromide content is over 90 mol%, care must be taken to obtain the cubic crystal form of the silver halide. Particularly, in the case of silver bromide, silver iodobromide or silver (iodo)-chlorobromide containing 95 mol% or more silver bromide, it is known that the precipitation of silver halide and the physical ripening thereof must be conducted at a controlled silver ion concentration so as to form cubic particles. Such conditions are conventional and are usually at about 40° to 80° C for up to about 2 hours. In order to prepare such a silver halide composition, it is necessary that a double jet preparation method involving keeping the pAg of the reaction solution at a constant value be carried out which comprises simultaneously adding an aqueous solution of a water soluble silver salt and an aqueous solution of a water soluble halide to an aqueous solution of hydrophilic colloid. The crystal form and the preparation method of cubic particles are described in C. E. K. Mees, "The Theory of the Photographic Process" 3rd. ed. Chapter 2, in detail and such can be used to prepare the cubic crystal form of the silver halide in the present invention. Furthermore, the preparation method of cubic particles as disclosed in C. R. Berry & D. C. Skillman, "Precipitation of Twinned AgBr Crystals" which is described in "Photographic Science and Engineering" vol. 6, No. 2 can be used.

As the silver chloride content in the silver halide particles is increased, silver halide particles having a cubic crystal form can be easily formed. Silver halide particles having a cubic crystal form can be prepared by an usual double jet method or a single jet method which comprises adding an aqueous solution of a water soluble silver salt to an aqueous solution of a hydrophilic colloid containing a water soluble halide with stirring (so long as the concentration of excess halide ion in the preparation step of the silver halide particles is not too high) as disclosed in E. Klein & E. Moiser, "Investigation of the Silver Halide Crystal Growth in Composite Systems" described in "International Congress of Photographic Science, Tokyo, 1967, Section I".

Silver halide particles containing at least 80 mol% of silver chloride are in the cubic form even if they are prepared under conditions such that a concentration of excess halide ion is too high.

It is preferred that the silver halide contained in the emulsion of the invention have an average particle size of not more than about 3 microns, more preferably an average size of from about 0.05 microns to not more than about 1 micron. The average particle size can be measured by the method disclosed in A. P. H. Trivelli & W. F. Smith, "Relations between Sensitometric and Size-frequency Characteristics in Photographic Emulsion Series" described in "Photographic Journal" vol. 79, pages 330– 338.

The particle size of the cubic form is determined by the length of any one edge of the cubic form. The particle size distribution can be broad or narrow without substantial impact on the present invention.

The silver halide photographic emulsion of this invention may be physically ripened or not, as desired. In the preparation of silver halide emulsions, water soluble salts are generally removed after forming the silver halide precipitate or physically ripening the silver halide, and for this purpose there can be employed any conventional method, for example, a noodle washing method or a flocculation method utilizing inorganic salts having polyvalent anions, anionic surface active agents, anionic polymers such as polystyrene-sulfonic acid or gelatin derivatives such as aliphatic or aromatic acylated gelatin.

The thus prepared silver halide emulsion is chemically ripened after adding an unstable sulfur compound thereto, and then one or more mercapto compounds of this invention is added to the emulsion. After adding the mercapto compound(s), the emulsion can also be ripened, if desired.

As examples of sulfur sensitizers (the unstable sulfur compounds above), any inorganic or organic compounds which are known sulfur sensitizers can be used. For example, a thiosulfate, an allyl thiocarbamide, a thiourea, an allyl isothiacyanate, a cystine, a p-toluene sulfonate, rhodanine, etc., are preferred. Further, compounds as disclosed in U.S. Pat. Nos. 1,574,944; 2,278,947; 2,410,689; 2,440,206; 3,189,458; 3,415,649 and 3,501,313, and French Patent No. 2,059,245, and active gelatin can be used in the invention. The amount of sulfur-containing compounds added is sufficient to effectively increase the sensitivity of the emulsion and can be widely varied in various conditions. The amount is generally about $10^{-5}$ to about $10^{-1}$ mol per mol of silver.

The sulfur compounds can be added by conventional methods. For example, a water soluble sulfur compound can be added as an aqueous solution thereof and an organic solvent soluble sulfur compound can be added as an organic solvent solution thereof by dissolving the same in a water miscible organic solvent such as methanol or ethanol.

In combination with the sulfur sensitization, the emulsion of the present invention can be sensitized by adding a noble metal salt such as platinum, iridium, rhodium or ruthenium as disclosed in U.S. Pat. Nos. 2,448,060; 2,540,086; 2,566,245 and 2,566,263.

The amount of the heterocyclic compound or compounds having a mercapto group added is enough to increase the sensitivity of the emulsion effectively. The amount can be widely varied, and is preferably $1 \times 10^{-5}$ to $1 \times 10^{-2}$ mol, more preferably $1 \times 10^{-4}$ to $5 \times 10^{-3}$ mol, per mol of silver halide.

The method of adding the mercapto compound can be in any manner by which conventional photographic additives are added to the emulsion. For example, it can be dissolved in a suitable solvent which has no harmful effect on the final light-sensitive material product, for example, conventional solvents which can be used to incorporate a photographic additive into a photographic emulsion such as water, methanol, ethanol, acetone, 2-methoxyethanol, dimethylformamide etc., and added thereto as a solution.

The hydrophilic colloid employed as a silver halide vehicle in the present invention is conventional. Such includes proteins (e.g., gelatin, colloid albumin, casein, etc.), cellulose derivatives (e.g., carboxymethyl cellulose, hydroxymethyl cellulose, etc.), a saccharide derivative (e.g., agar-agar, sodium alginate, starch derivatives, etc.), synthetic hydrophilic colloids (e.g., polyvinyl alcohol, poly(N-vinyl pyrrolidone), polyacrylic acid copolymers, polyacrylamide, etc.), and the like. If necessary, two or more colloids which are miscible with each other can be used.

Gelatin is effectively employed in this invention, and a part or all of the gelatin can be replaced by a synthetic high molecular weight substance. Gelatin can further be replaced by a gelatin derivative which is obtained by treating a functional group (e.g., amino group, imino group, hydroxy group or carboxy group) in the molecule of the gelatin with a reagent having at least one group reactive therewith, or by a graft gelatin which is obtained by bonding gelatin with a molecule chain of another high molecular substance. As exemplary reagents for forming gelatin derivatives there are isocyantes, acid chlorides and acid anhydrides as disclosed in U.S. Pat. No. 2,614,928, acid anhydrides as disclosed in U.S. Pat. No. 3,118,766, bromoacetic acids as disclosed in Japanese Patent Publication No. 5,514/64, phenyl glycidyl ethers as disclosed in Japanese Patent Publication No. 26,845/67, vinyl sulfone compounds as disclosed in U.S. Pat. No. 3,132,945, N-allyl vinylsulfonamides as disclosed in British Pat. No. 861,414, maleimide compounds as disclosed in U.S. Pat. No. 3,186,846, acrylonitriles as disclosed in U.S. Pat. No. 2,594,293, polyalkylene oxides as disclosed in U.S. Pat. No. 3,312,553, epoxy compounds as disclosed in Japanese Patent Publication No. 26,845/67, acid esters as disclosed in U.S. Pat. No. 2,763,639, and alkane sultones as disclosed in British Pat. No. 1,033,189.

Examples of high molecular weight substance which can be grafted onto gelatin are disclosed in U.S. Pat. Nos. 2,763,625; 2,831,767 and 2,956,884, "Polymer Letters" vol. 5, page 595 (1967), "Photographic Science and Engineering" vol. 9, page 148 (1965), and "Journal of Polymer Science" A-1, vol. 9, page 3199 (1971). As specific examples of such high molecular weight substances, there are homopolymers and copolymers of vinyl monomers such as acrylic acid, methacrylic acid or derivatives thereof (e.g., ester, amide, nitrile, etc.) or styrene.

Hydrophilic vinyl polymers miscible with gelatin are particularly preferred. Examples of such polymers are homopolymers or copolymers of acrylic acid, acrylamide, methacrylamide, hydroxyalkyl acrylate or hydroxyalkyl methacrylate.

To the silver halide emulsion of this invention, various compounds can be added to prevent fogging or to stabilize the photographic properties thereof in the preparation steps thereof, during storage thereof and during development thereof. For example, there can be used azoles such as benzotriazole, benzothiazolium salts as disclosed in U.S. Pat. No. ,2131,038 or aminobenzimidazoles as disclosed in U.S. Pat. No. 2,324,123; nitroazoles such as nitroindazole, nitrobenzotriazole or nitrobenzoimidazole as disclosed in British Pat. No. 403,789, or nitroaminobenzimidazole as disclosed in U.S. Pat. No. 2,324,123; halogen substituted azoles such as 5-chlorobenzimidazole, 5-bromobenzimidazole or 6-chlorobenzimidazole; oxazolinethion as disclosed in U.S. Pat. No. 3,251,691; triazolothiadiazole as disclosed in Japanese Patent Publication No. 17,932/68, etc. A nitrogen-containing heterocyclic compound having an antifogging function such as an azaindene compound, e.g., tetrazaindenes as disclosed in U.S. Pat. Nos. 2,444,605; 2,444,606; 2,450,397; Japanese Patent Publications 10,166/64 and 10,516/67 or pentaazaindenes as disclosed in U.S. Pat. No. 2,713,541 and Japanese Patent Publication No. 13,495/68; or urazole as disclosed in U.S. Pat. No. 2,708,161 can be added to the emulsion. Further, benzene sulfinic acid as disclosed in U.S. Pat. No. 2,394,198, benzene thiosulfinic acid and benzene sulfinic amide as disclosed in Japanese Patent Publication No. 4,136/68 can be added. There can also be employed sulfocatechols as disclosed in U.S. Pat. No. 3,236,652; oximes as disclosed in British Pat. No. 623,448; nitron; polyvalent metal salts as disclosed in U.S. Pat. No. 2,839,405; thiuronium salts as disclosed in U.S. Pat. No. 3,220,839; and salts of palladium, platinum and gold as disclosed in U.S. Pat. Nos. 2,566,263 and 2,597,915. In order to preventing fog generation due to metal ions, various chelating agents as disclosed in U.S. Pat. No. 2,691,588, British Pat. No. 623,488 and Japanese Patent Publications Nos. 4,941/68 and 13,496/68 can be added to the emulsion of the invention, if desired.

The above materials are added in conventional art-recognized amounts to achieve the recited purpose.

A photographic emulsion layer or other hydrophilic colloid layer, for example, a protective layer, filter layer, intermediate layer, anti-halation layer, subbing layer, etc., in the light-sensitive material of this invention can contain, to increase sensitivity, contrast or to accelerate development, polyalkylene oxides as disclosed in U.S. Pat. No. 2,441,389, ethers, esters or amides of polyalkylene oxides as disclosed in U.S. Pat. No. 2,708,161 and polyalkylene oxide derivatives as disclosed in British Pat. No. 1,145,186 or Japanese Patent Publications Nos. 10,989/70, 15,188/70, 43,435/71, 8,106/72 and 8,742/72; thioether compounds as disclosed in U.S. Pat. Nos. 3,046,132 and 3,046,135 or Japanese Patent Publications Nos. 9,019/70 and 11,119/72; and thiomorpholines as disclosed in Japanese Patent Publication No. 28,325/72; quarternary ammonium compounds as disclosed in U.S. Pat. No. 3,772,021; pyrrolidines as disclosed in Japanese Patent Publication No. 27,037/70; urethane or urea derivatives as disclosed in Japanese Patent Publication No. 23,465/65; imidazole derivatives as disclosed in Japanese Patent Publication No. 45,541/72; polymers as disclosed in Japanese Patent Publication No. 26,471/70; and 3-pyrazolidones as disclosed in Japanese Patent Publication No. 27,670/70.

To the photographic emulsion of the light-sensitive material of the invention one can add an inorganic or organic mercury compound for the purpose of sensitization or fog prevention. Examples of such compounds include mercury complex salts as disclosed in U.S. Pat. No. 2,728,664, benzothiazole mercury salts as disclosed in U.S. Pat. No. 2,728,667, mercury salt-addition compounds as disclosed in U.S. Pat. Nos. 2,728,663 and 2,732,302, or organic mercury compounds as disclosed in U.S. Pat. Nos. 2,728,665 and 3,420,668.

In the case that the silver halide particle size is particularly small, for example, smaller than 0.4 micron or even 0.2 micron, a compound as disclosed in British Pat. Nos. 1,316,493, 1,317,138, 1,317,139, 1,317,709, 1,297,901 and German Patent Application (Laid Open) No. 2,235,031 is generally added as a sensitizer to the photographic emulsion.

The emulsion can be hardened in a conventional manner, if desired. As examples of commonly used hardening agents, there are aldehyde compounds such as formaldehyde or glutaraldehyde; ketone compounds such as diacetyl or cyclopentandion; halogen-containing compounds such as bis(2-chloroethyl urea), 2-hydroxy-4,6-dichloro-1,3,5-triazine or compounds as disclosed in U.S. Pat. Nos. 3,288,775 and 2,732,303, British Pat. Nos. 974,723 and 1,167,207; reactive olefine compounds such as divinyl sulfone, 5-acetyl-1,3-diacryloylhexahydro-1,3,5-triazine or compounds as disclosed in U.S. Pat. Nos. 3,232,763 and 3,635,718 and British Pat. No. 994,869; N-methylol compounds such as N-hydroxymethyl phthalimide or compounds as disclosed in U.S. Pat. Nos. 2,732,316 and 2,586,168; isocyanates as disclosed in U.S. Pat. No. 3,103,437; aziridine compounds as disclosed in U.S. Pat. Nos. 3,017,280 and 2,983,611; acid derivatives as disclosed in U.S. Pat. Nos. 2,725,294 and 2,725,295; carbodiimides as disclosed in U.S. Pat. No. 3,100,704; epoxy compounds as disclosed in U.S. Pat. No. 3,091,537; isooxazole compounds as disclosed in U.S. Pat. Nos. 3,321,313 and 3,543,292; halogenated aldehyde-carboxylic acids such as mucochloric acid, dioxane derivatives such as dihydroxydioxane or dichlorodioxane, and inorganic hardening agents such as chrom alum or zirconium sulfate. In place of the above compounds, a precursor of a hardening agent such as an alkali metal bisulfite adduct, methylol derivative of hydantoine or a primary aliphatic nitroalcohol may be used.

The photographic emulsion of the invention can contain one or more surface active agents as are generally used as coating aids, and in some cases, such can be used as an emulsifier, sensitizer, to improve photographic properties, for antistatic purposes or for adhesion-preventing purposes. The surface active agents include non-ionic suface active agents which are natural such as saponin, or of the alkylene oxide type, glycerol type or glycidol type; cationic surface active agents such as higher alkylamines, quarternary ammonium salts, pyridine and other heterocyclic compounds and phosphoniums or sulfoniums; and anionic surface active agents such as compounds having an acidic group, e.g., carboxylic acid, sulfonic acid, phosphoric acid, sulfate ester group or phosphate ester group; and amphoteric surface active agents such as aminoacids, aminosulfonic acids or sulfuric or phosphoric acid esters of aminoalcohols. Specific examples of such surface active agents are disclosed in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application (Laid Open) No. 1,942,665, British Pat. Nos. 1,077,317 and 1,198,450, Ryohei Oda, "Synthesis of Surface Active Agents and Application thereof" Maki Shoten in Japan (1964), A. W. Perry, "Surface Active Agents" Interscience Pub. Inc. (1958) and J. P. Sisley "Encyclopedia of Surface Active Agents (Vol. 2)" Chemical Pub. Co. (1964).

If the silver halide photographic emulsion of the invention is employed for color photographic light-sensitive materials, a color-forming coupler and a dispersing agent therefor can be incorporated in the emulsion, if desired.

The silver halide photographic emulsion of the invention can contain any conventional non-diffusible color forming coupler. As such couplers, there are 4-equivalent or 2-equivalent diketomethylene yellow couplers such as are disclosed in U.S. Pat. Nos. 3,277,157, 3,415,652, 3,447,928, 3,311,476, 3,408,194, etc., couplers as disclosed in U.S. Pat. Nos. 2,875,057, 3,265,506, 3,409,439, 3,551,155, 3,551,156, etc., and compounds as disclosed in Japanese Patent Application (Laid Open) Nos. 26,133/72 and 66,836/73; 4-equivalent or 2-equivalent pyrazolone type magenta couplers or indazolone type magenta couplers such as disclosed in U.S. Pat. Nos. 2,600,788, 2,983,608, 3,006,759, 3,062,653, 3,214,437, 3,253,924, 3,419,391, 3,419,808, 3,476,560 and 3,582,322, Japanese Patent Publication No. 20,636/70 and Japanese Patent Application (Laid Open) No. 26,133/72; alphanaphthol type cyan couplers or phenol type cyan couplers such as disclosed in U.S. Pat. Nos. 2,474,293, 2,698,794, 3,034,892, 3,214,437, 3,253,924, 3,311,476, 3,458,315 and 3,591,383 and in Japanese Patent Publications Nos. 11,304/67 and 32,461/69. In addition, there can be used DIR couplers such as disclosed in U.S. Pat. Nos. 3,148,062, 3,227,554, 3,297,445, 3,253,924, 3,311,476, 3,379,529, 3,516,831, 3,617,291, 3,622,328, 3,701,738 and 3,705,801 and in German Patent Application (Laid Open) No. 2,163,811. The couplers can be dispersed by any conventional method, e.g., the method disclosed in U.S. Pat. No. 2,801,171, etc.

To the silver halide photographic emulsion of this invention there can be added a plasticizer and latex polymer for dimensional stability and a matting agent, if desired. The thus prepared finished emulsion is coated on a suitable support.

A rigid support such as glass, metal or earthenware, or a flexible support such as paper or plastic can be used, depending upon the end use, to provide a light-sensitive material. The photographic emulsion is usually coated on the support so that 0.1 – 2 mg/cm$^2$ of silver halide is included in a layer, but the amount of silver halide is not limited to this range.

As typical examples of the flexible supports, there are those commonly used for photographic light-sensitive materials such as cellulose nitrate film, cellulose acetate film, cellulose acetate butyrate film, cellulose propionate film, polystyrene film, polyethylene terephthalate film, polycarbonate film, laminated sheets of such films, thin glass film, paper, etc. As papers there can be used baryta papers, papers coated or laminated with alpha-olefin polymers, especially alpha-olefin polymers having 2 to 10 carbon atoms, such as polyethylene, polypropylene or ethylene-butene copolymers, and plastic films whose adhesion to other high molecular weight substances and printability are improved by matting the surface of the films as disclosed in Japanese Patent Publication No. 19,068/72.

The supports can be transparent or opaque, depending on the use of the light-sensitive material. If necessary, the transparent or opaque support can be colored by adding dyes or pigments thereto. An opaque support can be opaque in itself, such as paper, or obtained by adding dyes or pigments such as titanium dioxide to a transparent support, a surface-treated plastic film as disclosed in Japanese Patent Publication No. 19,068/72; or a paper or plastic film which shields light by the addition of carbon black. If the adhesive force between the support and the photographic emulsion layer is insufficient, a conventional subbing layer which has good adhesion can provided on the support.

The silver halide photographic emulsions of the invention can be used in various color or black & white light-sensitive materials. Such emulsions include, e.g., emulsions for color positives, emulsions for color papers, emulsions for color negatives, emulsions for color reversals (which may or may not contain color-forming couplers), photographic light-sensitive materials for the graphic arts (e.g., litho-type light-sensitive materials), emulsions for X-ray recording, light-sensitive materials for direct or indirect photography using a screen, emulsions for use in a colloid transfer process (as described in, e.g., U.S. Pat. No. 2,716,059), emulsions for use in a silver salt diffusion transfer process (e.g., as described in U.S. Pat. Nos. 2,352,014, 2,543,181, 3,020,155, 2,861,855, etc.), emulsions for use in a color diffusion transfer process (e.g., as described in U.S. Pat. Nos. 3,087,817, 3,185,567, 2,983,606, 3,253,915, 3,227,550, 3,227,551, 3,227,552, 3,415,644, 3,415,645, 3,415,646, etc.), emulsions for use in a dye transfer process (e.g., as described in U.S. Pat. No. 2,882,156), emulsions for use in a silver dye-bleaching process (see. e.g., Friedman; "History of Color Photography", particularly Chapter 24, (American Photographic Publishers Co. 1944) and "British Journal of Photography", vol. 111, pages 308 to 309 (Apr. 7, 1964), emulsions for materials to record print-out images (e.g., see U.S. Pat. No. 2,369,449, Belgian Pat. No. 704,255 etc.), emulsions for print-out light-sensitive materials of the light-developable type (e.g., see U.S. Pat. Nos. 3,033,682, 3,287,137, etc.), emulsions for thermally developable light-sensitive materials (e.g., see U.S. Pat. Nos. 3,152,904, 3,312,550, 3,148,122, British Pat. No. 1,110,046, etc.), emulsions for physically developable light-sensitive materials (e.g., see British Pat. Nos. 920,277, 1,131,238, etc.) and the like.

The silver halide photographic emulsions of the invention are particularly useful for litho-type photographic light-sensitive materials, coupler-incorporated multi-layer color photographic light-sensitive materials (particularly for reversal color use and negative color use), high speed black & white negative light-sensitive materials, negative light-sensitive materials for microfilms, etc. In this specification, the term litho-type light-sensitive materials means materials capable of reproducing high contrast images (line or dot images) by infectious development with a developer containing dihydroxybenzenes as a developing agent and a small amount of sulfite ion, as are disclosed in L. F. A. Mason, "Photographic Processing Chemistry" pages 163 to 165 (1966), in detail.

The present invention will be illustrated in more detail by the following Examples, but the invention is not to be construed as limited thereto.

EXAMPLE 1

A photographic emulsion containing silver bromide having cubic crystals of a mean grain size of 0.7 micron (determined by conventional election microscopy) was prepared by the double jet process, that is, to an aqueous gelatin solution containing 0.25 wt% ammonia an aqueous solution of silver nitrate and an aqueous solution of potassium bromide were simultaneously added with stirring over a 40 minute period at 50° C while keeping the silver ion concentration at $1.25 \times 10^{-8}$ mol/liter. 0.38 mol/kg of silver bromide and about 45 g/kg of gelatin were present in this emulsion.

The thus prepared emulsion was divided into two 600g samples. To one sample, 2 ml of a 1 wt% aqueous solution of sodium thiosulfate (pentahydrate) as a sulfur sensitizer was added and then the emulsion was heated at 50° C for 1 hour, whereby the emulsion was sulfur-sensitized.

The sulfur sensitized emulsion was then divided into two 300g samples. 0 ml. and 3 ml. of $5 \times 10^{-2}$ mol/liter of compound (III) earlier identified was added, and then each emulsion was coated on a cellulose acetate transparent film having coated thereon a gelatin subbing layer at a dry thickness of about 4 microns to provide three different photographic light-sensitive materials (two of 300 g sulfur sensitized; one of 600 g not).

Each of the three samples formed was exposed through a continuous wedge (optical wedge) and a blue filter [SP-1, having the characteristics shown in FIG. 1] to a tungsten lamp having a color temperature of 2854° K for 10 seconds. After exposure, each sample was developed with a Metol-ascorbic acid developing a solution for 10 minutes at 20° C. The developer was prepared by dissolving 2.5 g of Metol, 10 g of ascorbic acid, 1 g of potassium bromide and 35 g of sodium metaborate in enough water to make 1 liter (pH 9.8). Photographic densities were measured by a densitometer manufactured by Fuji Photo Film Co., Ltd. Photographic sensitivity was determined in terms of the reciprocal number of the exposure necessary to provide a photographic density of fog + 0.1, and is shown in Table 1.

Table 1

| | Silver bromide emulsion having 95 wt% of cubic crystals of 0.7 micron | | |
|---|---|---|---|
| Test No. | Sodium thiosulfate pentahydrate (mg/mol.AgBr) | Compound (III) (millimol/mil.AgBr) | Relative Sensitivity |
| | 0 | 0 | 21 |
| 1 | 87.7 | 0 | 100 (control) |
| | 87.7 | 1.3 | 316 |

As is apparent from the sensitivity values of Table 1, the sensitivity of the emulsion which was sulfur-sensitized and which contained the mercapto compound was higher than that of the emulsion which had only been sulfur-sensitized.

COMPARATIVE EXAMPLE 1

The same procedure as in Example 1 was repeated except that the cubic silver bromide particles were replaced by octahedral silver bromide particles (100% non-cubic) and the sulfur-containing compound shown in Table 2 was added. The results shown in Table 2 were obtained.

Table 2

| Test No. | Silver bromide emulsion having octahedral crystals of 0.7 micron: Sodium thiosulfate pentahydrate (mg/mol.AgBr) | Compound (III) (millimol/mol.AgBr) | Relative Sensitivity |
|---|---|---|---|
| 2. | 0 | 0 | 26 |
| (For | 0 | 1.3 | 26 |
| comparison) | 0 | 5.2 | 14 |
| 3. | 2.2 | 0 | 63 |
| (For | 2.2 | 1.3 | 54 |
| comparison) | 2.2 | 5.2 | 18 |
| 4. | 4.4 | 0 | 100 |
| (For | 4.4 | 1.3 | 100 |
| comparison) | 4.4 | 5.2 | 26 |
| 5. | 8.8 | 0 | 100 (control) |
| (For | 8.8 | 1.3 | 81 |
| comparison) | 8.8 | 5.2 | 23 |
| 6. | 17.5 | 0 | 85 |
| (For | 17.5 | 1.3 | 68 |
| comparison) | 17.5 | 5.2 | 19 |
| 7. | 35.1 | 0 | 65 |
| (For | 35.1 | 1.3 | 52 |
| comparison) | 35.1 | 5.2 | 13 |
| 8. | 70.2 | 0 | 44 |
| (For | 70.2 | 1.3 | 35 |
| comparison) | 70.2 | 5.2 | 13 |
| 9. | 140.4 | 0 | 33 |
| (For | 140.4 | 1.3 | 22 |
| comparison) | 140.4 | 5.2 | 4 |

As is apparent from the sensitivity values of Table 2, the sensitivity of the silver halide emulsions containing octahedral particles was not increased even if the heterocyclic mercapto compound was added after sulfur-sensitizing the emulsion to various degree by the sulfur-containing compound.

COMPARATIVE EXAMPLE 2

A photographic emulsion containing silver bromide particles as tabular form crystals having a mean grain size of 1.1 $\mu$ was prepared by a conventional single jet process, i.e., to an aqueous potassium bromide solution containing gelatin an aqueous solution of silver nitrate was added with stirring at 60° C over a 60 minute period.

0.30 mol/kg of silver bromide and about 45 g/kg of gelatin were present in the emulsion.

The same procedure as in Comparative Example 1 was repeated using the above emulsion. The results obtained are shown in Table 3.

Table 3

| Test No. | Silver bromide emulsion having tabular form particles (% cubic) of mean grain size of 1.1 micron: Sodium thiosulfate pentahydrate (mg/mol.AgBr) | Compound (III) (millimol/mol.AgBr | Relative sensitivity |
|---|---|---|---|
| 10. | 0 | 0 | 20 |
| (For comparison) | 0 | 1.3 | 20 |
| | 0 | 5.3 | 11 |
| 11. | 5.6 | 0 | 78 |
| (For comparison) | 5.6 | 1.3 | 78 |
| | 5.6 | 5.3 | 37 |
| 12. | 11.1 | 0 | 100 |
| (For comparison) | 11.1 | 1.3 | 100 |

Table 3-continued

| Test No. | Silver bromide emulsion having tabular form particles (% cubic) of mean grain size of 1.1 micron: Sodium thiosulfate pentahydrate (mg/mol.AgBr) | Compound (III) (millimol/mol.AgBr | Relative sensitivity |
|---|---|---|---|
| | 11.1 | 5.3 | 34 |
| 13. | 22.2 | 0 | 100 |
| (For comparison) | 22.2 | 1.3 | 87 |
| | 22.2 | 5.3 | 15 |
| 14. | 44.4 | 0 | 78 |
| (For comparison) | 44.4 | 1.3 | 58 |
| | 44.4 | 5.3 | 55 |
| 15. | 88.9 | 0 | 68 |
| (For comparison) | 88.9 | 1.3 | 30 |
| | 88.9 | 5.3 | 3 |

As is apparent from the sensitivity values of Table 3, the sensitivity of a silver bromide emulsion having tabular form particles was not increased even if the heterocyclic mercapto compound was added after sulfur-sensitizing the emulsion to various degree with the sulfur sensitizer.

Though silver halide particles of cubic form, octahedral form or tabular form are typical crystal shapes, an increase of sensitivity is only achieved with silver halide emulsions of cubic crystal shape, as is apparent from Example 1 and Comparative Examples 1 and 2.

EXAMPLE 2

To 2000 g of a cubic silver bromide emulsion having a particle size of 0.7 micron prepared as in Example 1, 6.7 ml. of 1 wt% aqueous solution of sodium thiosulfate (pentahydrate) was added, and the resulting emulsion was heated (ripened) at 50° C for 60 minutes, whereby the emulsion was sulfur-sensitized. The emulsion was divided into 100 g samples to 7 of which a methanol solution of a mercapto compound as set forth in Table 4 was added, and the resulting emulsions then coated to a dry thickness of about 4 microns on a cellulose acetate transparent film having a gelatin subbing layer thereon to provide photographic light-sensitive materials.

The sensitivity of the light-sensitive materials was measured by the same manner as in Example 1 and is shown in Table 4.

Table 4

| Test No. | Silver bromide emulsion having 95 wt% of cubic crystals of a particle size of 0.7 micron: Sodium thiosulfate pentahydrate (mg/mol.AgBr) | Mercapto compound | Addition Amount (millimol/mol.AgBr) | Relative Sensitivity |
|---|---|---|---|---|
| 16. (For comparison) | 89 | | 0 | 100 (control) |
| 17. | 89 | (II) | 0.5 | 145 |
| 18. | 89 | (V) | 0.3 | 151 |
| | 89 | (VI) | 0.3 | 170 |
| 19. | 89 | (VI) | 0.5 | 178 |
| | 89 | (VI) | 1.1 | 174 |
| | 89 | (VI) | 2.1 | 186 |

EXAMPLE 3

The same procedure as in Example 2 was repeated using Compound (I), (III), (IV) or (VII) and 2-mercapto-benzimidazole (hereinafter referred to as MBI) as shown in Table 5. The sensitivity values obtained after testing as in Example 1 are shown in Table 5 together with the pKa of the compounds.

Table 5

| Test No. | Mercapto Compound | pKa | Addition Amount (millimol/mol.AgBr) | Relative Sensitivity |
|---|---|---|---|---|
| | Silver bromide emulsion having 95 wt% of cubic crystals of a particle size of 0.7 micron (sulfur-sensitized) | | | |
| 20. | — | — | 0 | 100 (control) |
| 21. | (I) | 6.4 | 0.3 | 186 |
| | (I) | 6.4 | 0.5 | 220 |
| | (I) | 6.4 | 1.1 | 159 |
| | (I) | 6.4 | 2.1 | 170 |
| 22 | (III) | 3.7 | 1.1 | 148 |
| | (III) | 3.7 | 2.1 | 145 |
| 23. | (IV) | 4.9 | 1.1 | 151 |
| | (IV) | 4.9 | 2.1 | 316 |
| 24. | (VII) | 7.3 | 0.5 | 162 |
| | (VII) | 7.3 | 1.1 | 182 |
| 25. (For comparison) | MBI | 10 | 0.3 | 83 |
| | MBI | 10 | 0.5 | 72 |
| | MBI | 10 | 1.1 | 81 |
| | MBI | 10 | 2.1 | 100 |

It can be seen from the pKa and sensitivity values in Table 5 that the sensitizing effect of this invention is not attained by using a compound having a pKa of more than 7.6.

EXAMPLE 4

To 2000 g of a cubic silver bromide emulsion having a particle size of 0.7 micron prepared as in Example 1 3.3 ml. of a 1 wt% aqueous solution of sodium thiosulfate (pentahydrate) was added and the emulsion ripened at 50° C for 60 minutes, whereby the emulsion was sulfur-sensitized.

The emulsion was divided into 100 g samples to 16 of which a methanol solution of a mercapto compound as shown in Table 6 was added and then the emulsions were coated to a dry thickness of about 4 microns on a transparent cellulose acetate film having a gelatin subbing layer to provide photographic light-sensitive materials.

The procedure of Example 1 was then repeated except that the tungsten lamp for exposure was replaced by a xenon flash lamp, a blue filter manufactured by Fuji Photo Film Co., Ltd. (Trade name: BPN-45) was used and the exposure time was 0.01 second. The sensitivity of the emulsion was then measured with the results shown in Table 6, in which the gamma value of the characteristic curve is shown.

Table 6

| Test No. | Sodium thiosulfate pentahydrate (mg/mol.AgBr) | Mercapto compound | Addition Amount (millimol/mol.AgBr) | Relative Sensitivity | |
|---|---|---|---|---|---|
| | Silver bromide emulsion having 95 wt% of cubic crystal of a particle size of 0.7 micron | | | | |
| 26. (For comparison) | 44 | — | 0 | 100 (control) | 3.3 |
| 27. | 44 | (I) | 0.3 | 166 | 3.4 |
| | 44 | (I) | 0.5 | 145 | 3.3 |
| 28. | 44 | (II) | 0.3 | 148 | 2.3 |
| | 44 | (II) | 0.5 | 158 | 2.1 |
| 29. | 44 | (III) | 1.1 | 166 | 3.5 |
| | 44 | (III) | 2.1 | 145 | 3.0 |
| 30. | 44 | (V) | 0.3 | 232 | 2.0 |
| | 44 | (V) | 0.5 | 200 | 1.1 |
| 31. | 44 | (VI) | 0.3 | 174 | 3.7 |
| | 44 | (VI) | 0.5 | 209 | 3.1 |
| | 44 | (VI) | 1.1 | 200 | 3.1 |
| | 44 | (VI) | 2.1 | 200 | 3.1 |
| 32. | 44 | (VII) | 0.3 | 200 | 2.7 |
| | 44 | (VII) | 0.5 | 204 | 2.7 |
| | 44 | (VII) | 1.1 | 167 | 2.3 |

It will be understood from the sensitivity values of Table 4 and 6 that an increase in sensitivity due to the addition of the heterocyclic mercapto compound with high intensity exposure (e.g., short time flash exposure) can be attained (Example 4) as well as with low intensity exposure (long tome exposure) (Examples 1 and 2).

EXAMPLE 5

A photographic emulsion comprising silver chloride particles of a cubic shape having a mean grain size of 0.3 micron was prepared by a conventional double jet method, i.e., to an aqueous gelatin solution, an aqueous solution of silver nitrate and an aqueous solution of sodium chloride were simultaneous added with stirring at 60° C over a 60 minute period. 0.29 mol/kg of silver chloride and about 45 g/kg of gelatin were present in the emulsion.

The thus prepared emulsion was divided into 600 g samples to which 2 ml. or 4 ml. of a 0.1 wt% aqueous solution of sodium thiosulfate (pentahydrate) was added and the emulsion then ripened at 50° C for 1 hour, whereby the emulsion was sulfur-sensitized.

The emulsion was then divided into 50 g samples. To each sample, 0 ml., 2.5 ml. or 5 ml. of a methanol solution of $10^{-2}$ mol/liter of a mercapto compound as shown in Table 7 was added and the resulting emulsions coated to a dry thickness of about 4 microns on a transparent cellulose acetate film having a gelatin subbing layer to provide photographic light-sensitive materials.

The results obtained by using the above light-sensitive materials in the same manner as in Example 1 are shown in Table 7.

Table 7

| Test No. | Sodium thiosulfate pentahydrate (mg/mol.AgBr) | Compound (III) (millimol/mol.AgBr) | Relative Sensitivity |
|---|---|---|---|
| | Silver chloride emulsion having 95 wt% of cubic crystal of a mean grain size of 0.3 micron | | |
| 33. | 12 | 0 | 66 |
| | 12 | 1.7 | 159 |
| | 12 | 3.5 | 182 |
| 34. | 13 | 0 | 100 (control) |
| | 13 | 1.7 | 251 |
| | 13 | 3.5 | 230 |

It can be seen from the sensitivity values of Table 7 that an increase in sensitivity due to the mercapto compound is also attained with a silver chloride emulsion.

While the invention has been described in detail and with reference to specific embodiments thereof, it will be apparent to one skilled in the art that various changes and modifications can be made therein without departing from the spirit and scope thereof.

What is claimed is:

1. A chemically sulfur-sensitized silver halide photographic emulsion which contains:
   (1) at least 80 mol% silver bromide or silver chloride; wherein at least 80% by weight of all of the silver halide particles present are of the cubic crystal form; and in addition to said sulfur sensitizer
   (2) a sensitizing amount of an organic compound having at least one mercapto group and capable of reacting with a silver ion to form a water-insoluble silver salt, said organic compound having a 1,3,4-thiadiazole ring and a pKa of not more than 7.6, said pKa is measured in water at 25° C at an ionic strength of 0.1.

2. The silver halide photographic emulsion as claimed in claim 1 wherein 90% or more of the silver halide particles in the emulsion by weight are in the cubic crystal form.

3. The silver halide photographic emulsion as claimed in claim 1 wherein said silver halide is selected from the group consisting of silver bromide, silver iodobromide containing not more than 3 mol% of silver iodide, silver chloroiodobromide containing not more than 3 mol% of silver iodide and at least 80 mol% of silver bromide or silver chlorobromide containing at least 80 mol% of silver bromide.

4. The silver halide photographic emulsion as claimed in claim 1 wherein said silver halide is selected from the group consisting of silver bromide or silver iodobromide containing not more than 3 mol% of silver iodide.

5. The silver halide photographic emulsion as claimed in claim 1 wherein said silver halide is selected from the group consisting of silver chlorobromide containing at least 80 mol% of silver bromide or silver chloroiodobromide containing at least 80 mol% of silver bromide and not more than 3 mol% of silver iodide.

6. The silver halide photographic emulsion as claimed in claim 1 wherein said silver halide is silver bromide.

7. A method for increasing a sensitivity of sulfur-sensitized silver halide photographic emulsion which comprises adding a sensitizing amount of an organic compound having at least one mercapto group and capable of reacting with a silver ion to form a water-insoluble silver salt to a sulfur-sensitized photographic emulsion containing at least 80 mol% of a member selected from the group consisting of silver bromide or silver chloride, wherein said pKa is measured in water at 25° C at an ionic strength of 0.1, said organic compound having a 1,3,4-thiadiazole ring and a pKa of not more than 7.6.

8. The method as claimed in 7 wherein 90% or more of the silver halide particles in the emulsion by weight are in the cubic crystal form.

9. The method as claimed in claim 7 wherein said silver halide is selected from the group consisting of silver bromide, silver iodobromide containing not more than 3 mol% of silver iodide, silver chloroiodobromide containing not more than 3 mol% of silver iodide and at least 80 mol% of silver bromide or silver chlorobromide containing at least 80 mol% of silver bromide.

10. The method as claimed in claim 7 wherein said silver halide is selected from the group consisting of silver bromide or silver iodobromide containing not more than 3 mol% of silver iodide.

11. The method as claimed in claim 7 wherein said silver halide is selected from the group consisting of silver chlorobromide containing at least 80 mol% of silver bromide or silver chloroiodobromide containing at least 80 mol% of silver bromide and not more than 3 mol% of silver iodide.

12. The silver halide photographic emulsion of claim 1, wherein said organic compound is:

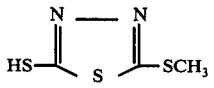

13. The process of claim 7, wherein said organic compound is:

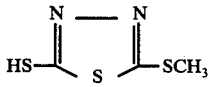

* * * * *